United States Patent [19]

DiGiovanni, Jr.

[11] 4,073,100

[45] Feb. 14, 1978

[54] MAUSOLEUM AND METHOD OF CONSTRUCTION

[76] Inventor: Francis J. DiGiovanni, Jr., 105 Paradise Harbor, Apt. 508, North Palm Beach, Fla. 33408

[21] Appl. No.: 707,312

[22] Filed: July 21, 1976

[51] Int. Cl.[2] ..... E04H 13/00

[52] U.S. Cl. ..... 52/79.3; 52/79.9; 52/79.13; 52/136

[58] Field of Search ..... 52/79.1, 79.9, 79.3, 52/79.13, 79.14, 122, 583, 587, 124, 128–142, 79.5, 234, 236.3

[56] References Cited

U.S. PATENT DOCUMENTS

| | | | |
|---|---|---|---|
| 1,395,632 | 11/1921 | Easterday | 52/587 |
| 3,350,821 | 11/1967 | Jones | 52/122 |
| 3,372,519 | 3/1968 | Russell | 52/587 |
| 3,754,805 | 8/1973 | Pangburn et al. | 52/136 |
| 3,861,093 | 1/1975 | Robinson | 52/79.14 |
| 3,881,571 | 5/1975 | Moulton | 52/79.3 |

FOREIGN PATENT DOCUMENTS

| | | | |
|---|---|---|---|
| 1,520,408 | 3/1968 | France | 52/79.3 |

*Primary Examiner*—James L. Ridgill, Jr.
*Attorney, Agent, or Firm*—Malin & Haley

[57] ABSTRACT

An improved mausoleum and the method of construction, the mausoleum including a plurality of stacked, preformed, molded fiberglass or plastic crypts, interlocked together at crypt corners by metal fastening plates bolted to fastening rods partially embedded in the end faces of each crypt. Vertical columns of crypts are supported on a concrete or other conventional foundation. Each bottom crypt in a particular vertical column includes adjustable leveling supports to accommodate for variations in the surface of the foundation. A non-load bearing supporting shell or facade of decorative masonry or other material may be used to house an entire tier of crypts. Each crypt includes one or more vertically disposed, rigid supporting structural members embedded in each crypt side wall, the support member ends forming tenons which are interlocked with vertically adjacent crypt tenons to provide increased vertical compression force loading for the stacked vertical columns of crypts. Each crypt includes a sealed closure which is receivable over one end face of the crypt for sealing after a body has been interred.

4 Claims, 5 Drawing Figures

MAUSOLEUM AND METHOD OF CONSTRUCTION

BACKGROUND OF THE INVENTION

This invention relates generally to an improved mausoleum and the construction thereof, and specifically to a mausoleum which may be constructed at reduced labor and material cost without reducing structural integrity or available crypt space.

In recent years, mausoleums have been constructed using poured concrete to form an integral tiered array of enclosures. The use of poured concrete requires rigid, strengthened structural support walls necessary to support the entire structure. Other teachings in the prior art show the use of preformed concrete slabs which are arranged in tiers of crypts, which again require expensive and elaborate overall structures for the necessary support of the extremely heavy concrete tiers.

The mausoleum described herein overcomes the problems of the prior art by utilizing a plurality of lightweight fiberglass receptacles which are interlocked together in a self-supporting tiered or stacked array, alleviating the need for an elaborate rigid exterior supporting structure. Further, the tiered array of crypts may be enclosed in a relatively lightweight non load bearing, concrete structure that need only provide a finish. Each preformed fiberglass crypt includes a pair of rigid fastening rods embedded near the end faces of the vertical walls of the crypt, vertical support structural members disposed within the crypt vertical support walls and vertical tenons, the crypts stacked to form a self-supporting, interlocked, array of lightweight fiberglass crypts.

Utilizing the instant invention, the construction of a mausoleum is more efficient, less time consuming and less costly. The preformed fiberglass crypts having the end face fastening rods need only be stacked in a rectangular array of rows and columns. The corners of each crypt are interlocked to adjacent crypts by a rigid mounting plate connected to the exposed ends of the crypt fastening rods by suitable fasteners. The lower corners of the bottom row of crypts are connected to the concrete foundation. Each bottom crypt includes an adjustable leveling means connected to the concrete foundation to compensate for surface irregularities in the foundation which might otherwise detrimentally affect the vertical loading of each tier column. After the deceased is interred in an individual crypt, a fiberglass closure may be sealed over the end face, permanently sealing the crypt.

BRIEF DESCRIPTION OF THE INVENTION

A mausoleum having a plurality of preformed fiberglass crypts, said crypts being stacked and interlocked together in rows and columns. Each crypt has embedded in each side wall one or more rigid vertical supporting structural members which protrude at top or bottom forming tenons to vertically interlock each column. The opposite surface of each crypt includes recessed portions aligned with the vertical support member to allow vertical stacking, providing in-line vertical structural support from the top crypt to the bottom crypt in each vertical column. The crypt fastening rods adjacent each crypt end face have threaded protruding ends that are interlocked together at each crypt corner by a rigid metal plate having apertures that receive the threaded ends which are bolted to the plate, providing shear support to the stacked crypts at each four corner crypt junction.

The stacked array of crypts are placed on a conventional concrete foundation. A lightweight concrete exterior shell or facade may be utilized with relatively thin, non load bearing support walls and ceiling to encompass and enclose the fiberglass crypts.

To compensate for unlevel irregularities in the surface of the foundation (normally concrete) each crypt disposed at the bottom of a vertical column includes a leveling device which is coupled between the foundation and the crypt itself to provide vertical adjustment for accurately leveling a bottom crypt in each crypt column.

Each crypt is constructed with an open end face and is substantially (in the preferred embodiment) an elongated rectangular box made of fiberglass or other lightweight plastic material which can be molded or formed in any conventional manner. A removable closure fits over the open end face and after a body is interred into the crypt the closure is hermetically sealed to permanently entomb the corpse.

It is an object of this invention to provide an improved mausoleum utilizing a stacked array of preformed lightweight crypts which are interlocked together at their corners and covered by an exterior shell.

Another object of this invention is to provide a relatively low cost improved mausoleum which reduces construction and labor time and the cost of materials.

But still yet another object of this invention is to provide an improved building structure fabricated with lightweight interlocked modules formed in vertical and horizontal columns and rows respectively.

And still yet another object of this invention provides an improved mausoleum having tiers of crypts which includes vertical support structural members imbedded in the crypt walls, allowing the crypts to be stacked to provide integral vertical supports for increasing compression loading.

In accordance with these and other objects which will be apparent hereinafter, the instant invention will now be described with particular reference to the accompanying drawings.

PREFERRED EMBODIMENT OF THE INVENTION

Figure 1:
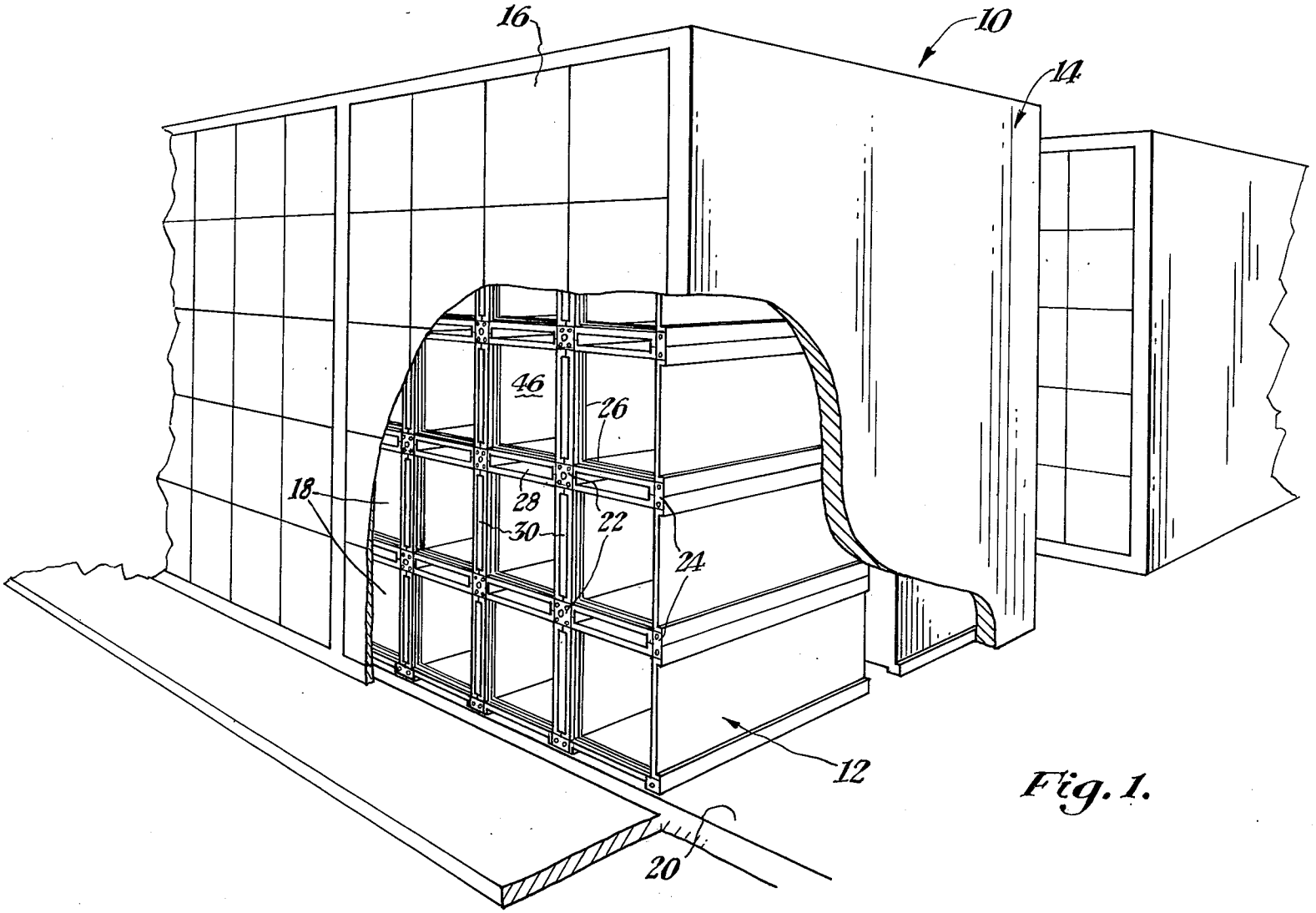
FIG. 1 shows a perspective view, partially cut-away of a mausoleum constructed in accordance with the present invention.

Referring now to the drawings and specifically FIG. 1, the instant invention is shown generally at 10 comprised of a plurality of pre-formed fiberglass crypts 12, stacked one on another to form side by side vertical columns. Each crypt is interlocked at each corner to surrounding, adjacent crypts by fastening plate 22. The entire crypt array is surrounded by a building shell or facade having vertical walls 14 and a front finish 16, the shell providing no structural support to the crypt array. Since the shell wall 14 and the front finish 16 bear none of the crypt load, the amount of construction materials for shell construction are greatly reduced. Each crypt includes an enlarged, raised lip portion at each corner such that in a stacked array, air spacing chambers 28 are formed between vertical stacked crypts. Likewise, between the vertical columns, air spaces 30 are formed by the sides of adjacent crypts. This allows for proper ventilation throughout the structure.

Each crypt includes a removable closure 18 (shown only on two crypts in FIG. 1) which may be sealed and placed against seal 26, completely sealing the crypt after a body is interred.

Disposed along the end vertical column of the mausoleum are fastening plates 24 which attach to the end faces of the crypts along one side of the tier of crypts.

The exterior front of the shell 14 can include a marble facade such as blocks 16 which constitute a decorative exterior wall which is mounted on the front face and can be attached and held by fasteners attached to the crypt connectors. A conventional concrete foundation 20 supports the shell and tier of crypts.

Figure 2A:
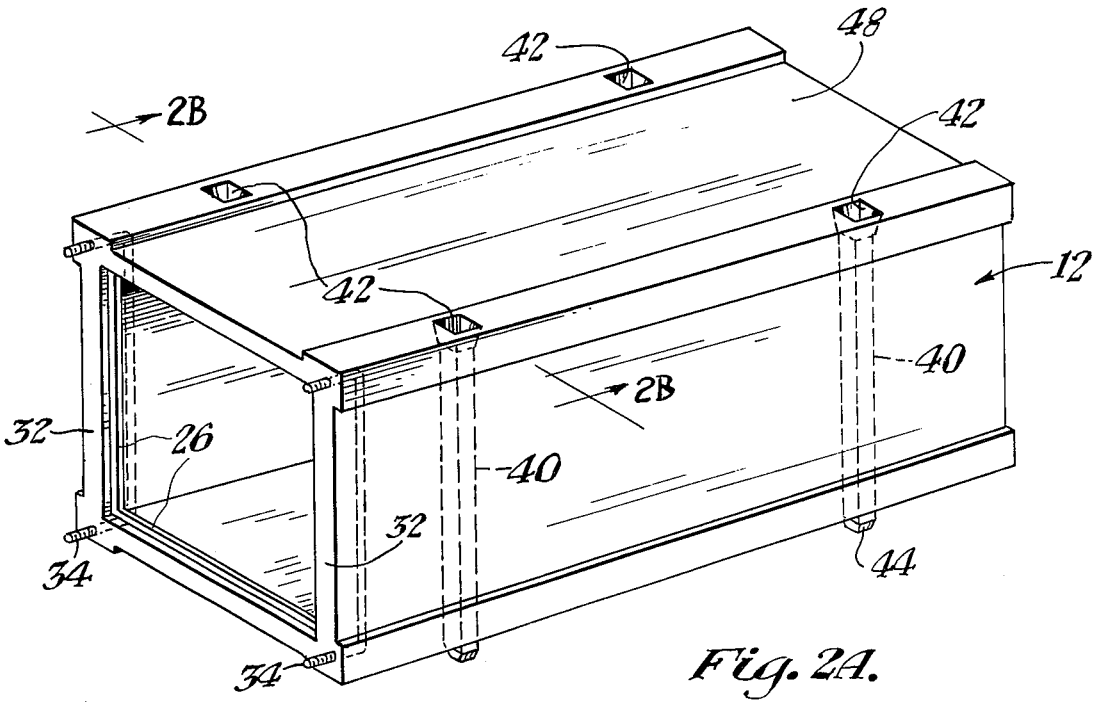
FIG. 2*a* shows a perspective view of one of the preformed crypts, partially cut-away as utilized in the instant invention.

Referring now to FIG. 2A, a single crypt 12 is shown constituting substantially a rigid rectangular receptacle having an open end face and a seal 26 disposed around the front inside edge of the open face. A removable closure, not shown in FIG. 2A, fits over the open space and is placed against seal 26 permanently closing it once the body is interred. The vertical side walls of crypt 12 include a pair of rigid vertical support structural members 40 having tenons 44 protruding from the bottom of the crypt, while the crypt top wall includes recessed portions 42 which receive tenons from a crypt stacked above. The crypt body may be of a fiberglass or other molded plastic type material and has enlarged lip portions at the corners, with the supporting members 40 being embedded, except for the exposed tenon 44, within the side walls. The end opposite face 32 is integrally formed with the side walls and is closed. Disposed adjacent the end face 32 are a pair of fastening rods 34 which are embedded vertically in the side walls of the crypt and have threaded exposed protrusions which receive bolts for fastening the rods to the interlocking plates 22 (FIG. 3).

Figure 2B:
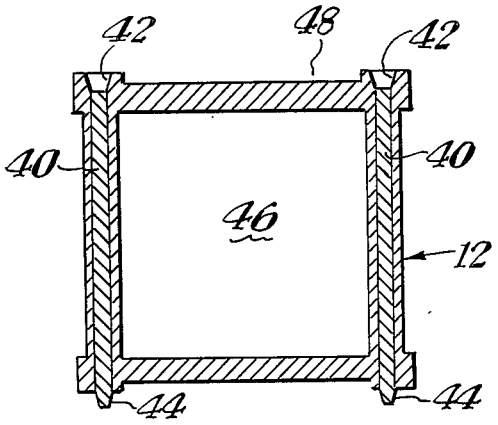
FIG. 2*b* shows a cross-section of the crypt shown in FIG. 2*a* through lines 2*b*—2*b*.

FIG. 2B shows a rigid metal vertical support structure 40 and tenon 44 protruding from the base embedded within the vertical support walls of the crypt 12, and the recessed portions 42 above the structural members 40 disposed along the upper surface of the crypt 12. The surfaces on the exterior including upper surface 48 have a raised lip portion at the corner which acts to form a void or air space between crypt side walls for proper ventilation within the mausoleum. The tenons 44 could protrude from either top or bottom of the crypt.

Figure 3:
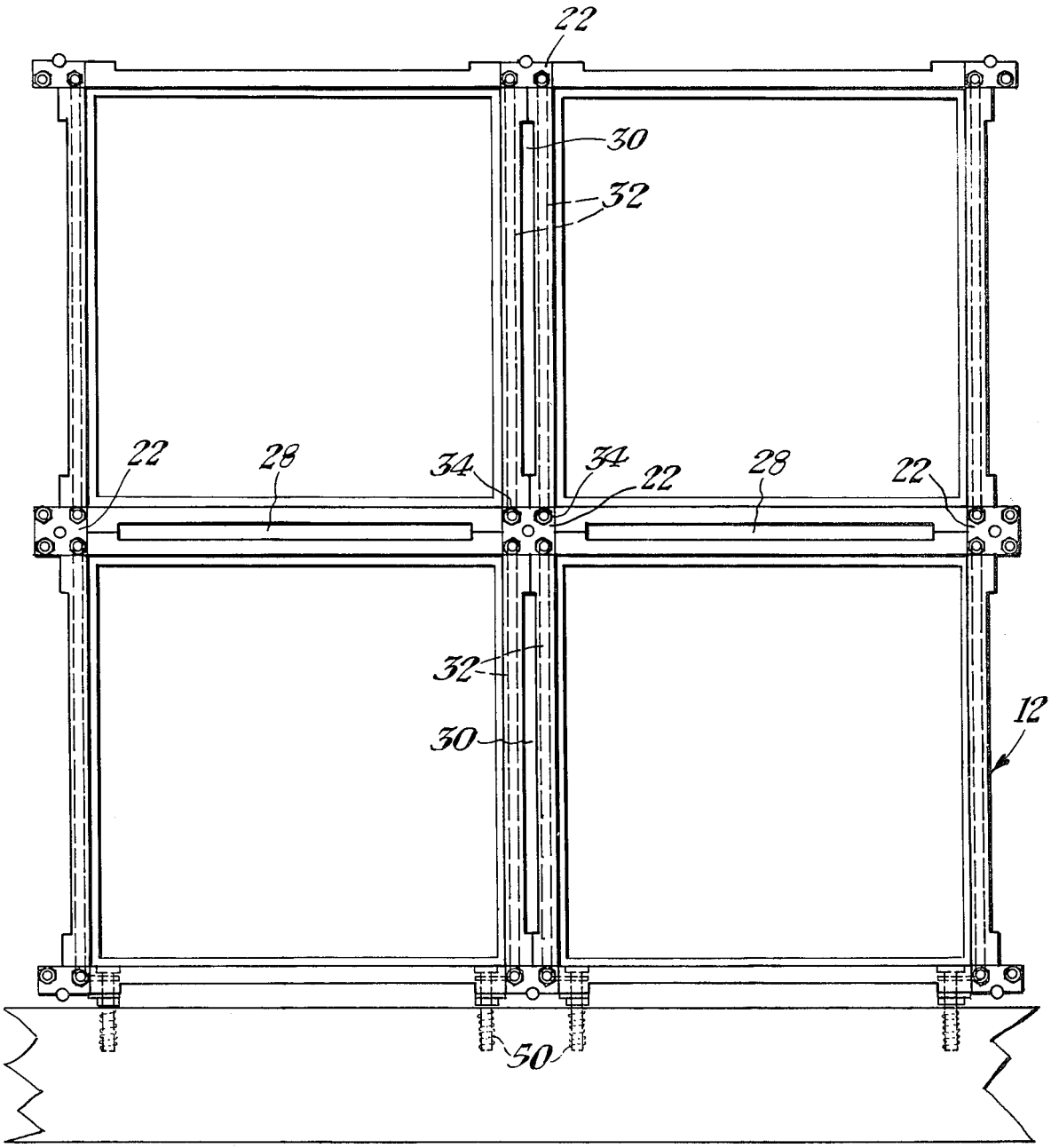
FIG. 3 shows a front elevational view of a plurality of crypts stacked and interlocked in accordance with the instant invention.

FIG. 3 shows four crypts joined together in accordance with the instant invention. The bottom two crypts are coupled to the foundation with a leveling means 50 disposed at each corner which allows individual bottom crypts to be vertically leveled relative to the foundation. When the crypts are joined together, upper and lower crypts form air passages 28 between them, while side-by-side crypts have air passages 30 disposed between them resulting from the raised corner support of the crypt. The fastening plates 22 have apertures which receive threaded ends 34 of the fastening rods connected by nuts 38 (FIG. 4) at all four corners of the crypts and their junction, firmly locking at each corner segment of the four crypt corners together. This provides for additional sheer force resistance.

Figure 4:
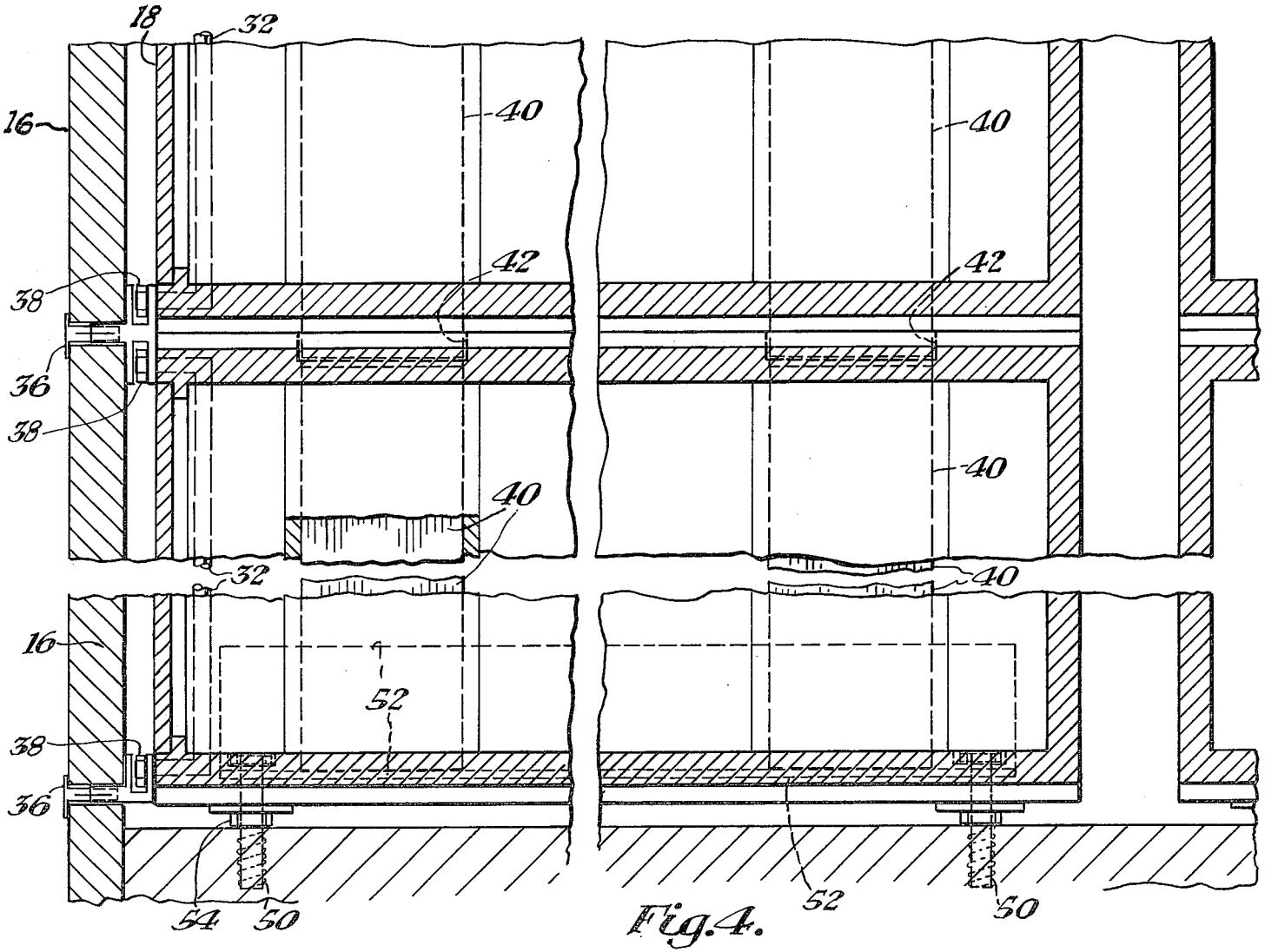
FIG. 4 shows a side elevational view partly in cross-section of a pair of the stacked crypts locked together in accordance with the instant invention.

FIG. 4 shows the leveling means 50 embedded and anchored in the foundation and includes a large threadable and moveable nut 54 which can be adjusted vertically to insure the proper leveling of the lower crypts. As shown in FIG. 4, the fastening rods 32 have a locking plate secured by nut 38 with the locking plate including an additional fastener 36 which is used to receive and hold the facade 16 to the front of the entire structure.

The bottom crypt may include an embedded, rigid, L-shaped plate running along the bottom corner of each crypt for additional support which receives the bottom end of support member 40. The L-shaped plate provides additional rigidity to the bottom tier and additional support for the leveling means.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved mausoleum comprising:

a plurality of rectangular, hollow receptacles stacked upon and adjacent each other to form an array of receptacles disposed in rows and columns, each of said receptacles including a top wall, first and second opposite end faces, first and second sidewalls, and a bottom wall;

a plurality of reinforcing rods disposed substantially vertically near the first and second sidewalls of each of said receptacles and embedded therein and each rod end protruding outwardly from each end face from each sidewall;

a plurality of rigid plates, each of said plates having a plurality of apertures, each plate being attachable to different reinforcing rod ends of different adjacent receptacles; and connecting means for attaching said plates to said protruding reinforcing ends whereby the corners of each of said adjacent receptacles are connected together by different plates, each plate resisting the shear force on the receptacle array.

2. A mausoleum, as in claim 1, wherein:

each of said receptacles including at least one rigid vertically disposed support member embedded in each sidewall and positioned to be aligned with a similar support member in a different receptacle stacked above or below said receptacle.

3. A mausoleum, as in claim 2, including:

an ornamental facade;

means for connecting each receptacle to said facade;

a foundation disposed under said receptacle row and column array;

means for attaching said bottom row of receptacles in said array to said foundation; and means coupled to said foundation and attached to said bottom row of receptacles for leveling each receptacle in said bottom row.

4. A mausoleum formed from a column and row array for crypts joined together comprising:

a plastic, rectangular box, said box having a top wall, first and second sidewalls, a bottom wall and a first end wall, said box having one end face being open;

a plurality of U-shaped supporting rods, each of said rods being disposed vertically in said first and second sidewalls in said box, each of said reinforcing rods having ends that protrude from the end face of each box near the upper and lower corners of each box;

a removeable sealable end face closure connected to each of said boxes;

plurality of vertical support members, vertically embedded in each of said sidewalls from the top to the bottom of each of said sidewalls;

at least one rigid plate for connecting adjacent box corners together having a plurality of apertures for receiving said protruding rod ends for joining adjacent corners of said receptacles; and means for connecting said rod ends to said plate.

* * * * *